United States Patent [19]

Lari et al.

[11] Patent Number: 4,982,796

[45] Date of Patent: Jan. 8, 1991

[54] ELECTROMAGNETIC CONFINEMENT FOR VERTICAL CASTING OR CONTAINING MOLTEN METAL

[75] Inventors: Robert J. Lari, Aurora; Walter F. Praeg, Palos Park; Larry R. Turner, Naperville, all of Ill.

[73] Assignee: ARCH Development Corp., Chicago, Ill.

[21] Appl. No.: 259,387

[22] Filed: Oct. 18, 1988

[51] Int. Cl.[5] ..... B22D 27/02

[52] U.S. Cl. ..... 164/467; 164/503

[58] Field of Search ..... 164/466, 467, 502, 503

[56] References Cited

U.S. PATENT DOCUMENTS

| | | | |
|---|---|---|---|
| 4,541,472 | 9/1985 | Eriksson et al. | 164/468 |
| 4,607,681 | 8/1986 | Tinnes et al. | 164/453 |
| 4,762,653 | 8/1988 | Senillou et al. | 164/503 |

FOREIGN PATENT DOCUMENTS

| | | | |
|---|---|---|---|
| 7521075 | 7/1975 | France . | |
| 55-48462 | 4/1980 | Japan | 164/467 |
| 57-177861 | 11/1982 | Japan . | |
| 60-106651 | 6/1985 | Japan . | |
| 62-104653 | 5/1987 | Japan . | |
| 62-199249 | 9/1987 | Japan | 164/467 |

*Primary Examiner*—Kuang Y. Lin

[57] ABSTRACT

An apparatus and method adapted to confine a molten metal to a region by means of an alternating electromagnetic field. As adapted for use in the present invention, the alternating electromagnetic field given by $B_y=(-2\mu_o\rho gy)^{\frac{1}{2}}$ (where $B_y$ is the vertical component of the magnetic field generated by the magnet at the boundary of the region; y is the distance measured downward form the top of the region, $\rho$ is the metal density, g is the acceleration of gravity and $\mu_o$ is the permeability of free space) induces eddy currents in the molten metal which interact with the magnetic field to retain the molten metal with a vertical boudnary. As applied to an apparatus for the continuous casting of metal sheets or rods, metal in liquid form can be continuously introduced into the region defined by the magnetic field, solidified and conveyed away from the magnetic field in solid form in a continuous process.

23 Claims, 3 Drawing Sheets

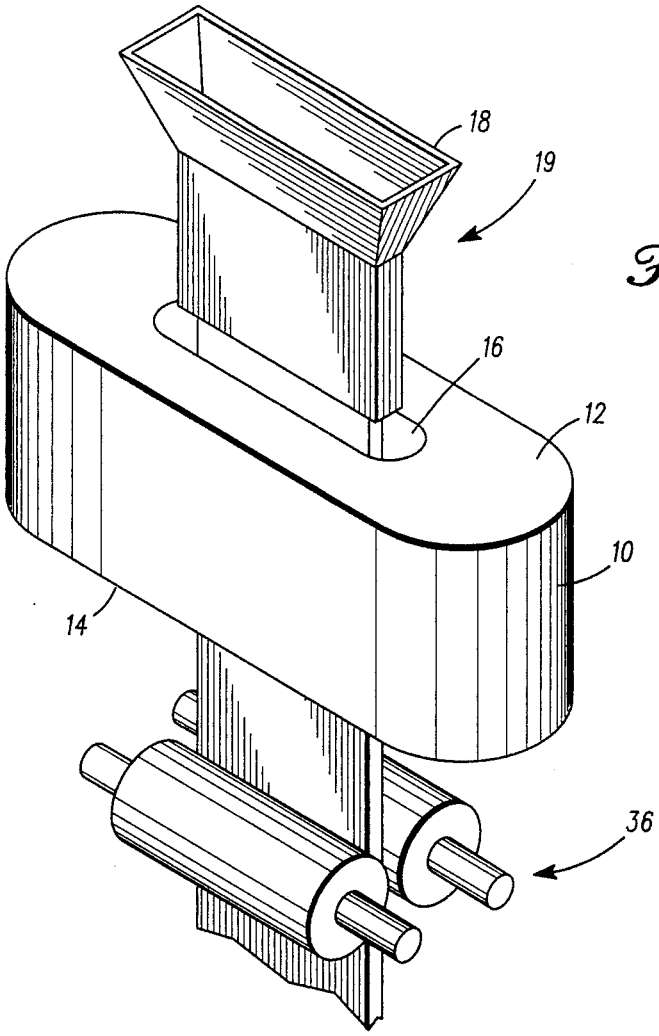
Fig. 1
Fig. 4
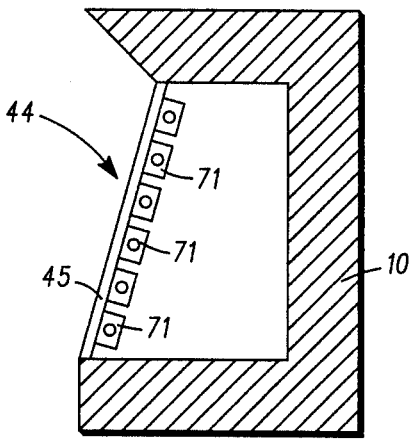
Fig. 5
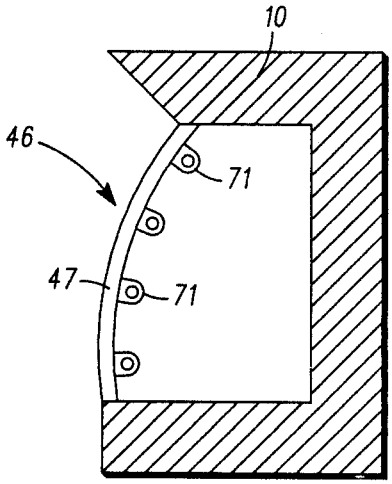

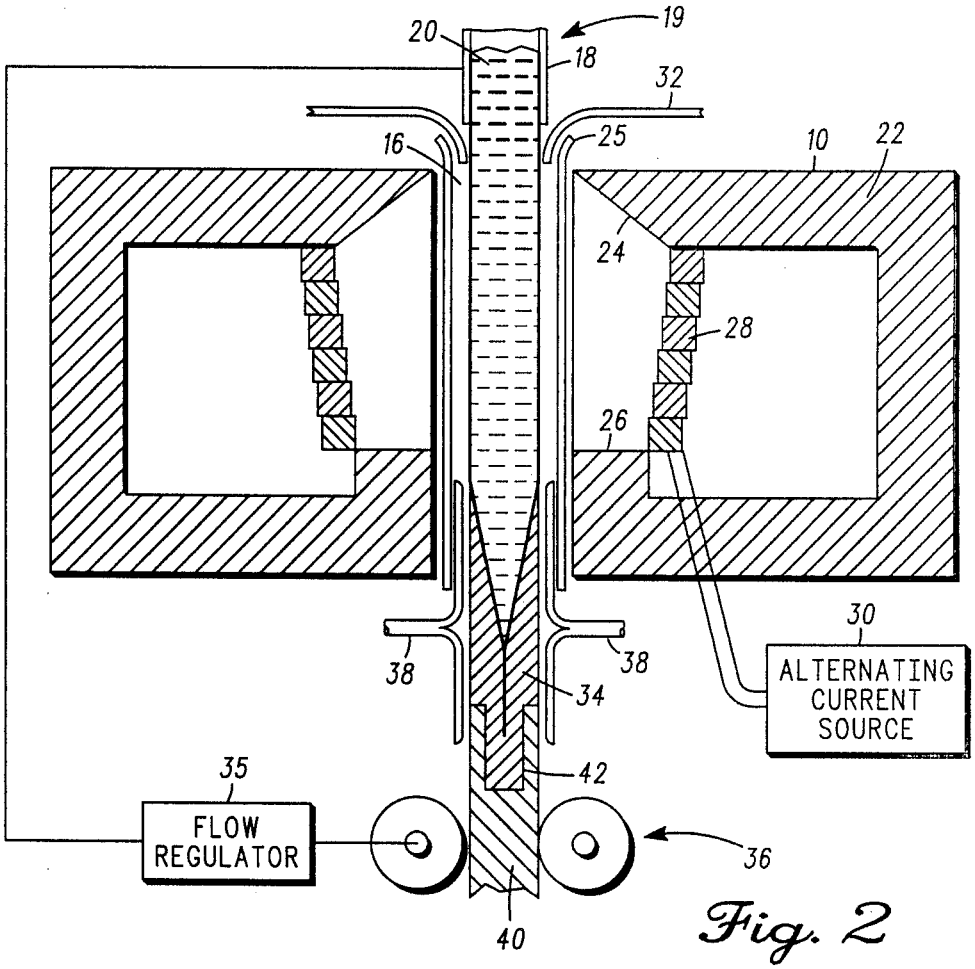
Fig. 2
Fig. 6
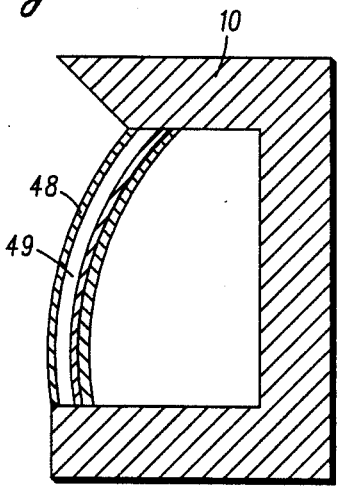
Fig. 7
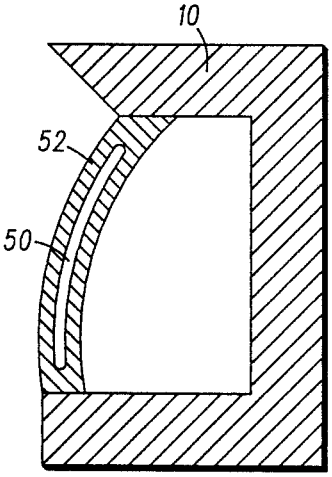

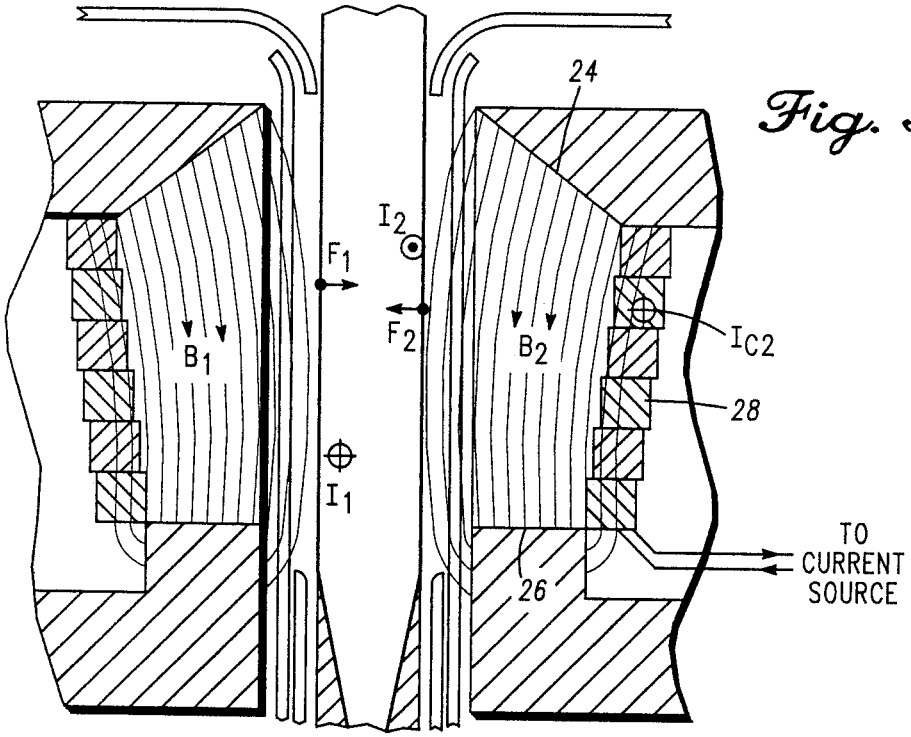
Fig. 3
Fig. 8
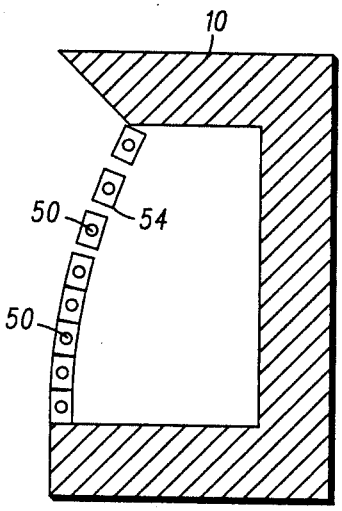
Fig. 9
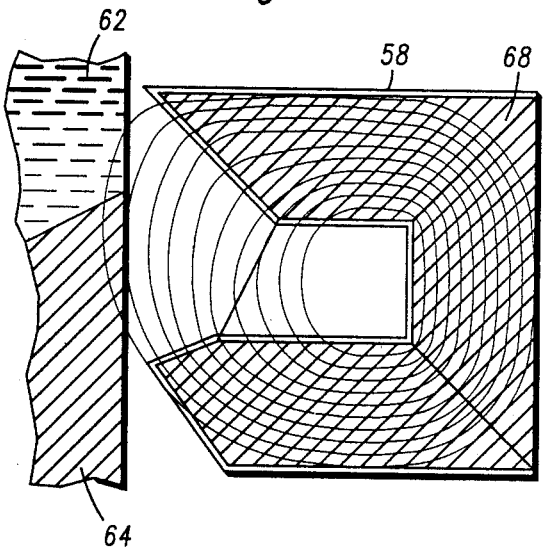

ELECTROMAGNETIC CONFINEMENT FOR VERTICAL CASTING OR CONTAINING MOLTEN METAL

CONTRACTUAL ORIGIN OF THE INVENTION

The United States Government has rights in this invention under Contract No. W-31-109-ENG-38 between the U.S. Department of Energy and the University of Chicago, operator of Argonne National Laboratory.

BACKGROUND OF THE INVENTION

This invention relates generally to the confinement of molten metal and is particularly directed to the vertical casting of metal sheets or rods using an electromagnetic field to form the casting mold.

Steel making occupies a central economic role and represents a significant fraction of the energy consumption of many industrialized nations. The bulk of steel making operations involves the production of steel plate and sheet. Present steel mill practice typically produces thin steel sheets by pouring liquid steel into a mold, whereupon the liquid steel solidifies upon contact with the cold mold surface. The solidified steel leaves the mold either as an ingot or as a continuous slab after it is cooled typically by water circulating within the mold wall during a solidification process. In either case, the solid steel is relatively thick, e.g., 6 inches or greater, and must be subsequently processed to reduce the thickness to the desired value and to improve metallurgical properties. The mold-formed steel is usually characterized by a surface roughened by defects, such as cold folds, liquation, hot tears and the like which result primarily from contact between the mold and the solidifying metallic shell. In addition, the steel ingot or sheet thus cast also frequently exhibits considerable alloy segregation in its surface zone due to the initial cooling of the metal surface from the direct application of a coolant. Subsequent fabrication steps, such as rolling, extruding, forging and the like, usually require the scalping of the ingot or sheet prior to working to remove both the surface defects as well as the alloy deficient zone adjacent to its surface. These additional steps, of course, increase the complexity and expense of steel production.

Steel sheet thickness reduction is accomplished by a rolling mill which is very capital intensive and consumes large amounts of energy. The rolling process therefore contributes substantially to the cost of the steel sheet. In a typical installation, a 10 inch thick steel slab must be manipulated by at least ten rolling machines to reduce its thickness. The rolling mill may extend as much as one-half mile and cost as much as $500 million.

Another approach to forming thin metal sheets involves casting into approximately the final desired shape. Compared to current practice, a large reduction in steel sheet total cost and in the energy required for its production could be achieved if the sheets could be cast in near net shape, i.e. in shape and size closely approximating the final desired product. This would reduce the rolling mill operation and would result in a large savings in energy. There are several technologies currently under development which attempt to achieve these advantages by forming the steel sheets in the casting process. While some of the approaches under investigation use electromagnetic energy, all of these approaches use a solid mold on one or both sides of the sheet. One disadvantage of a solid mold is that contact between the molten metal and the solid mold wall often produce an undesirable surface finish which requires subsequent processing to correct as pointed out above.

Previous inventions have employed electromagnetic fields as a substitute for the solid molds. For example, the use of electromagnetic levitation techniques has been employed for some time in the aluminum industry. The practice there is to use electromagnetic fields to contain the top inch or so of a large, thick ingot. The molten aluminum is cooled and solidified before it touches any mechanical support. Examples of this approach can be found in U.S. Pat. Nos. 3,467,166 to Getselev, 4,161,206 to Yarwood et al., and 4,375,234 to Pryor. U.S. Pat. No. 4,678,024 and No. 4,741,383 to Hull et al., were directed toward use of alternating electromagnetic fields to levitate an entire sheet of molten metal for horizontal casting.

There are several difficulties associated with the use of electromagnetic fields as a substitute for solid wall molds. Such difficulties include high energy requirements, large eddy currents, instabilities, and shaping the electromagnetic field to conform to the desired shape of the mold. For example, the Getselev patent describes a device for electromagnetic confinement of a metal, in particular aluminum, as it is cast into rods. The Getselev device employs metallic rings which form screens located at specific positions around the molten metal. These screens serve to shape and modify the magnetic field. The electromagnet of Getselev induces a current in the rings or screens. A frequency is chosen to make the skin depth about $\frac{1}{3}$ of the horizontal distance to the center. Eddy currents are generated in the molten aluminum to interact with the applied field and produce a containing force at the surface. In addition to these desirable eddy currents in the aluminum, there are also currents set up in the ring and screen. These currents are responsible for shaping the field but result in large power losses. In addition, the large magnetic fields in the air near the caster may interfere with other equipment and may be a safety hazard.

Another of the previous methods is described in the patents by Hull et al. The Hull et al. patents describe how molten steel could be poured through and solidified in an electromagnetic caster in a horizontal geometry. A horizontal geometry has the advantage of low eddy currents but the stability of the molten metal in the field would be weak.

Accordingly, an object of the present invention is to provide a magnetic field which can retain a molten metal with smooth, even vertical boundary.

It is another object of this invention to provide a casting system for shaping molten metal into various shapes without mechanical contact with a mechanical mold before the metal surface solidifies.

Another object of this invention is to produce steel sheet that requires little or no rolling after the casting operation.

A still further object is to produce steel that has good metallurgical properties and a good surface quality directly upon leaving the caster.

A yet further object of this invention is to provide a casting system with the molten metal in stable mechanical equilibrium within the caster.

A yet still further object of this invention is to provide a casting system for aluminum that uses much less power than existing techniques and confines the magnetic field to the required region.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects of the present invention, this disclosure provides an apparatus and method adapted to confine a molten metal to a region by means of an alternating electromagnetic field. As adapted for use in the present invention, the alternating electromagnetic field given by $B_y=(2\mu\rho gy)^{\frac{1}{2}}$ induces eddy currents in the molten metal which interact with the magnetic field to retain molten metal with a vertical boundary. As applied to an apparatus for the continuous casting of metal sheets or rods, molten metal can be continuously introduced into the region defined by the magnetic field, solidified and conveyed away from the region defined by the magnetic field in a continuous process.

BRIEF DESCRIPTION OF THE DRAWINGS

FIG. 1 depicts the present invention as adapted to a process for the continuous casting of solid metal sheets.

FIG. 2 depicts a cross section of the present invention as depicted in FIG. 1.

FIG. 3 is an enlarged cross section of the coil portion of the present invention as depicted in FIG. 2, including depiction of the magnetic field.

FIG. 4 is a sectional view of one embodiment of the coil of the present invention.

FIG. 5 is a sectional view of another embodiment of the coil of the present invention.

FIG. 6 is a sectional view of still another embodiment of the coil of the present invention.

FIG. 7 is a sectional view of yet another embodiment of the coil of the present invention.

FIG. 8 is a sectional view of yet still another embodiment of the coil of the present invention.

FIG. 9 is a sectional view of the coil of the present invention also displaying the magnetic field.

DETAILED DESCRIPTION OF THE INVENTION

The present invention achieves these objectives and addresses the difficulties previously associated with electromagnetic casting by, first, establishing the theoretical basis and requirements for electromagnetic confinement, and second, providing a magnet that fulfills these requirements.

The starting point for establishing the basis of the design of the present invention is that alternating current in a magnetic coil produces magnetic fields and eddy currents in the molten and solidifying steel. Further, these eddy currents and magnetic fields interact to produce confining forces. Starting from the basic equation for the Lorentz force, F, an electric current and a magnetic field interact according to the equation:

$$F=IL\times B$$

where I is a total current, L is length of conductor, and B is the magnetic field. The force for a distributed current, is found by integrating the product of current density J and flux density B:

$$\frac{F}{A}=\int_{x_1}^{x_2} J\,B dx$$

From Maxwell's equation for current density:

$$J=\frac{1}{\mu_o}\frac{\delta B}{\delta x}$$

where $\mu_o$ is the permeability of free space. Substituting for J then provides $$\frac{F}{A}=\frac{1}{\mu_o}\int_{x_1}^{x_2} B\frac{\delta B}{\delta x}dx=\frac{1}{2\mu_o}[B^2(x=x_2)-B^2(x=x_1)]$$

$B^2/2\ \mu$ is called the magnetic pressure.

The present invention uses a magnetic field to confine a sheet of molten metal as the molten metal moves vertically downward and solidifies.

The ferrostatic pressure $p_h$ exerted by the molten pool of metal increases linearly with increasing downward distance h from the surface of the pool $$p_h=g\rho h$$

where $\rho$ is the density of the metal, and g is the acceleration of gravity. The magnetic pressure exerted by the magnetic field must balance the static pressure everywhere from the region where the liquid metal enters the magnet to the region where a shell of metal has solidified sufficiently thick to withstand the static pressure. The magnetic pressure $p_m$ is given by $$p_m=B^2/2\mu_o$$

where B is the high frequency magnetic field (also called magnetic induction or flux density), parallel to the surface of the molten metal. The hydrostatic pressure ph increases linearly with increasing distance h downward from the top surface of the molten metal. To balance the ferrostatic pressure $p_h$, the magnetic pressure $p_m$ must do the same.

The magnetic field required to contain the molten metal can be determined by equating $p_m$ and $p_h$ $$p_m=p_h$$

and solving for the magnetic field, B $$B=(2\mu.g\rho h)^{\frac{1}{2}}.$$

From this, it follows that the magnetic field B must increase proportionately with the square root of h. The coils and pole pieces of the magnetic system are located to produce a magnetic field that varies in the required manner.

Accordingly, by relying on these design constraints the present invention can confine a molten metal by providing a magnetic field that can retain molten metal with a smooth, even vertical boundary. It is therefore suitable for use in a casting process wherein the magnetic field serves as a mold or boundary to retain the molten metal while it solidifies. Because the magnetic field provides a frictionless boundary to retain the molten metal, the present invention can be adapted to a continuous metal casting process wherein molten metal is continuously removed from the area after it solidifies.

Referring to FIG. 1, there is depicted the present invention as used in a casting process for forming sheets of metal. The present invention includes a magnet 10 having a top 12 and bottom 14. The magnet 10 has a central aperture 16 connecting the top 12 and bottom 14. Molten metal is supplied by a feed system 19 which may include a tundish 18 located above and adjacent to the central aperture 16 of magnet 10. Tundish 18 allows molten metal to flow by gravity or other means to the central region of the magnet 10 via aperture 16. The feed system may include flow regulators adapted to convey molten metal to the magnet at a desired rate. A support mechanism 36, such as rollers, support and carry away the solidified metal sheet as it leaves the caster.

FIG. 2 shows a cutaway view of the present invention. As previously described, the tundish 18 supplies molten metal 20 to the interior region of magnet 10 via aperture 16. The magnet 10 comprises yoke 22 connecting upper pole 24 and lower pole 26. A coil 28 is wound to surround the liquid metal 20 as shown. Coil 28 is connected to an alternating current source 30. Yoke 22 and poles 24 and 26 are made of a magnetic material of high permeability and low power loss for high frequency fields. Such a material is ferrite or metglass.

The magnetic field generated by magnet 10 confines the molten metal and retains the molten metal with generally vertical boundaries so that as it cools, the molten metal will be cast into a continuous sheet having a smooth surface. Cooling of the molten metal while it is in the magnet is provided by first cooling jets 32 located adjacent aperture 16. First cooling jets 32 spray streams of gas, such as nitrogen, argon, carbon dioxide, or a liquid around the molten metal 20 while the metal is being confined inside magnet 10 to facilitate cooling and solidification of the metal. In accordance with the design of this invention, the metal cools and solidifies while being confined by magnet 10. The solidified metal sheet 34 (depicted in FIG. 2 by the shaded region 34) is carried away from the magnet 10 by a support mechanism 36 which may be comprised of rollers which engage the solidified metal sheet 34 by friction. The support mechanism 36 would normally be synchronized with a flow regulator 35 associated with the tundish 18 to convey the cast metal sheet away at a rate compatible with introduction of molten metal from the tundish 18 to the magnet 10. Additional cooling can be provided by second cooling jets 38 located beneath magnet 10. Second cooling jets 38 serve to further cool the cast solidified metal 34 by spraying water or air on the metal 34 after it leaves magnet 10.

Located between the molten metal being cast and the magnet 10 and coil 28 is a heat shield 25. The heat shield 25 is designed to absorb radiated heat from the metal and protect the magnet and its coil from excessive heating.

FIG. 2 depicts how start up of the continuous casting process can be accomplished. Referring to FIG. 2, there is shown a leader sheet 40. Leader sheet 40 is designed to have dimensions similar to that of the cast metal sheet. The leader sheet is made of stainless steel or other nonmagnetic material. Leader sheet 40 is initially raised to a position in the magnet 10 within the area defined by the magnetic field. Leader sheet 40 will be long enough to extend below magnet 10 and would typically be engaged by support mechanism 36. Upon start up, the molten metal can be poured into the confinement region defined by the magnetic field generated by magnet 10. The molten metal will be prevented from pouring out the bottom of magnet 10 by leader sheet 40. Leader sheet 40 can then be retracted downward by support mechanism 36 at a rate to allow the molten metal to solidify before it leaves the magnet. This rate is determined based upon the cooling rate of the metal and the length of the magnet. The feed rate should also maintain the top of the liquid at a constant level so that the hydrostatic forces exerted by the molten metal likewise remain constant. A slot 42 may be included in the leader sheet 40 to provide additional stability between the leader sheet 40 and the metal being cast.

FIG. 3 depicts a close-up of the metal being cast as confined by the magnet also showing vector representations of the forces. The coil 28 has current $I_{c1}$ and $I_{c2}$ perpendicular to the plane of this view, with $I_{c1}$ coming out of the plane of the drawing, as indicated by the arrowhead, and $I_{c2}$ going into the plane of the drawing, as indicated by the arrow tail. This produces a magnetic field, indicated by the lines and $B_1$ and $B_2$. The frequency of the alternating current is chosen to make the skin depth small in comparison to the thickness of the molten metal generally in the range of approximately 100 kilohertz to 500 kilohertz. Typically, for molten steel, a frequency of 350 KHz results in a skin depth of 1 millimeter.

The magnetic field B generates eddy currents $I_1$ and $I_2$ in the skin of the molten metal. These eddy currents form closed loops in the skin of the metal and then interact with the magnetic field B thereby producing forces $F_1$ and $F_2$ in the skin of the metal that compress the metal as indicted in FIG. 3.

As previously stated, to balance the hydrostatic pressure, the tangential (vertical) component of magnet field, $B_y$, must obey $$B_y=(2\mu\rho g y)^{\frac{1}{2}}$$

or $$B_y=Ky^{\frac{1}{2}}$$

For casting steel, $K=-0.044$ if y is measured downwards in centimeters and $B_y$ in tesla. To achieve the desired field, the turns of magnet coil 28 are located along a surface of constant vector potential, and the faces of the poles 24 and 26 are located along surfaces of constant scalar potential.

A surface of constant vector potential conforms to the magnetic field lines as depicted in FIGS. 3 thru 9. A coil designed to be coincident with any of these lines will provide the magnetic field necessary to retain the molten metal with a vertical boundary. The surfaces of constant vector and scalar potential can be determined by solution of Maxwell's equations or by the following general equations for the magnetic field.

$$B_x = K(r/2)^{\frac{1}{2}}\left(\operatorname{Sin}\frac{\theta}{2} - \operatorname{Cos}\frac{\theta}{2}\right)$$

$$= \frac{K}{2}\left(((x^2+y^2)^{\frac{1}{2}} - x)^{\frac{1}{2}} - ((x^2+y^2)^{\frac{1}{2}} + x)^{\frac{1}{2}}\right)$$

-continued $$B_y = K(r/2)^{\frac{1}{2}}\left(\text{Sin}\,\frac{\theta}{2} + \text{Cos}\,\frac{\theta}{2}\right)$$

$$= \frac{K}{2}\left(((x^2+y^2)^{\frac{1}{2}} - x)^{\frac{1}{2}} + ((x^2+y^2)^{\frac{1}{2}} + x)^{\frac{1}{2}}\right)$$

$$A = \frac{-2^{\frac{1}{2}}Kr^{3/2}}{3}\left(\text{Cos}\,\frac{3\theta}{2} + \text{Sin}\,\frac{3\theta}{2}\right)$$

$$= \frac{K}{3}\left((x+y)((x^2+y^2)^{\frac{1}{2}} + x)^{\frac{1}{2}} + (x-y)((x^2+y^2)^{\frac{1}{2}} - x)^{\frac{1}{2}}\right)$$

$$\phi = \frac{2^{\frac{1}{2}}}{3}Kr^{3/2}\left(\text{Cos}\,\frac{3}{2}\theta - \text{Sin}\,\frac{3}{2}\theta\right)$$

$$= \frac{K}{3}\left((x-y)((x^2+y^2)^{\frac{1}{2}} + x)^{\frac{1}{2}} - (x+y)((x^2+y^2)^{\frac{1}{2}} - x)^{\frac{1}{2}}\right)$$

Where $r^2=x^2+y^2$ and $\theta=\tan^{-}y/x$. Although solution of the problem of achieving a magnetic field that exactly balances the hydrostatic forces of the molten metal leads to an initial coil design wherein the electric conductor of the coil 28 lies on surfaces of constant vector potential, it is possible and practical to construct the coil and pole faces at locations with other configurations so long as the field generated by the poles satisfies the design constraint that the coil and poles behave as if they lie on a surface of constant vector potential and scalar potential, respectively.

FIG. 4 shows an embodiment of the coil. In FIG. 4, a solid water-cooled, one-turn, excitation coil 45 is slanted to approximate the desired field, i.e. a line of constant vector potential. The one-turn copper sheet 45 prevents flux lines from crossing it. The sheet is cooled by water flowing in the tubes 71. In FIG. 5, the one-turn coil 46 is shaped to bound a flux line (no flux penetrates coil, therefore a surface of constant vector potential). Also included is one-turn copper sheet 47 cooled by tubes 71. In FIG. 6, the one-turn coil is made from individual insulated copper sheets 48 in order to reduce eddy current losses in the coil due to the excitation current. Coolant may flow between these parallel-connected sheets in channels 49. In FIG. 7 the excitation coil is made from a large number of relatively small conductors 50. These may be LITZ wires surrounding a heat sink 52. In FIG. 8 the water-cooled conductors 54 are placed along a flux line to produce the desired field.

Although the present invention has been discussed in terms of its application to the casting of steel into sheets, it can be adapted to the casting of other metals and different geometries. The invention is equally applicable to other metals such as aluminum, aluminum alloys, copper, copper alloys, but not limited to these. It is applicable to casting any electrically conducting fluid. For example, the present invention can be used for the production of aluminum ingots. For such an application, the magnet shape would be generally cylindrical (not necessarily a right circular cylinder) in order to form a magnetic field in the interior defining a cylindrical-shaped region having a boundary defined by the equation:

$$B_y=(2\mu\rho gy)^{\frac{1}{2}}$$

as in the previous description. Referring to FIG. 9, there is depicted a cutaway view of one side of the magnet 58 used to confine a cylindrical pool of aluminum 62 as it is cooled and cast into a cylindrical ingot 64. The yoke 68 restricts the magnetic field to the region indicated by the magnetic field lines. The present invention has several advantages over previous methods for the electromagnetic casting of aluminum, such as described in the Getselev reference. Principally, the advantages derive from designing the magnet so that the magnetic forces are applied to a maximum extent possible wholly to the confinement of the molten metal and not wasted. Therefore, the present invention eliminates the operational difficulties and safety hazards which accompany stray magnetic fields. Because of this, the present invention permits the use of electrically conducting and magnetic materials in other parts of the caster. Compared to the Getselev method, the present invention eliminates the need for rings and screens which in the Getselev reference are required to make the field small near the top of the liquid aluminum. Therefore, it eliminates the eddy current power losses in these rings and screens. Calculations based upon a comparison of the Getselev reference and the present invention indicate that the present invention may operate with only 5 percent of the power requirements of the Getselev device.

The embodiments of the invention in which an exclusive property or privilege is claimed are defined as follows:

1. An apparatus for confining molten metal to a region including:

a magnet having a top and a bottom, and a central aperture which is broadly elliptical connecting said top and said bottom, said magnet surrounding and defining a central region in which an alternating magnetic field generated by said magnet varies as $$B_y=(2\mu o\rho gy)_{1\ 2}$$

where $B_y$ is the vertical component of the magnetic field generated by said magnet at the boundary of said region, y is the distance measured downward from the top of the region, $\rho$ is the metal density, g is the acceleration of gravity and $\mu_o$ is the permeability of free space, wherein said magnet is comprised of:

an upper pole;

a lower pole;

a yoke connecting said upper pole and said lower pole; and a coil adjacent said yoke, said coil capable of being connected to an alternating electric current source whereby a current carried by said coil is capable of magnetizing said yoke and said upper and said lower poles, and, wherein the turns of said coil are located and shaped to conform to a line of constant vector potential of the magnetic field generated by said magnet, and the faces of said upper pole and said lower pole are located and shaped to conform to a line of constant scalar potential of the magnetic field generated by said magnet.

2. The apparatus of claim 1 wherein said magnet is adapted for the casting of molten metal and further wherein said magnet is constructed and adapted to allow a metal in liquid form to be introduced into one end of the central region defined by said magnet and a metal in solid form to be removed from the other end of the central region defined by said magnet.

3. The apparatus of claim 2 including a tundish located adjacent to and above said magnet, said tundish capable of conveying metal in liquid form to the central region defined by said magnet.

4. The apparatus of claim 3 including support means located adjacent to and below said magnet said support means being capable of supporting and carrying away a metal in solid form from said magnet.

5. The apparatus of claim 4 including:

first cooling jets located adjacent where metal in liquid form can be introduced to the central region defined by said magnet, said first cooling jets constructed and adapted to spray gas or liquid on a metal in liquid form confined by said magnet whereby the metal in liquid form can be cooled and solidified.

6. The apparatus of claim 5 including:

second cooling jets located adjacent where metal in solid form can be removed from the central region defined by said magnet, said second cooling jets constructed and adapted to spray gas or liquid on a metal after the metal has been removed from the central region defined by said magnet.

7. The apparatus of claim 6 in which the alternating magnetic field generated by said magnet has a frequency of approximately 350 kilohertz.

8. The apparatus of claim 7 including:

a heat shield located between said magnet and the central region defined by said magnet, said heat shield constructed and adapted to protect said magnet from heat.

9. The apparatus of claim 8 including:

a flow regulator constructed and adapted to be responsive to the speed or dimensions of metal in solid form being removed from the central region defined by said magnet, said flow regulator capable or regulating the flow of metal in liquid form from said tundish to the central region defined by said magnet so that the height of metal in liquid form retained by said magnet remains constant.

10. A method for confining molten metal to a region comprising the steps of:

maintaining an alternating magnetic field that defines a region having a vertical boundary given by $$B_y=(2\ \mu_o\ \rho g y)^{\frac{1}{2}}$$

where $B_y$ is the vertical component of the magnetic field generated by said magnet at the boundary of said region, y is the distance measured downward from the top of the region, $\rho$ is the metal density, g is the acceleration of gravity and $\mu_o$ is the permeability of free space, by means of a magnet which is comprised of:

an upper pole;

a lower pole;

a yoke connecting said upper pole and said lower pole; and, a coil adjacent said yoke, said coil capable of being connected to an alternating current source, locating and shaping the turns of said coil to conform to a line of constant vector potential of the magnetic field generated by said magnet, and locating and shaping the faces of said upper pole and said lower pole to conform to a line of constant scalar potential of the magnetic field generated by said magnet, and introducing said metal in liquid form to said region maintained by said magnetic field.

11. The method of claim 10 adapted for the continuous casting of molten metal into solid metal further comprising the step of:

removing the metal from the region defined by the alternating magnetic field after the metal has solidified.

12. The method of claim 11 in which the step of introducing a metal in liquid form is regulated in response to measurement of the speed or dimensions of the metal being removed from the region defined by the alternating magnetic field so that the height of metal in liquid form retained by the alternating magnetic field remains constant.

13. The method of claim 11 is which the alternating magnetic field operates at a frequency of approximately 100 kilohertz to 500 kilohertz.

14. The method of claim 11 including the step of:

cooling the metal in liquid form in the region defined by the alternating magnetic field.

15. The method of claim 14 in which the metal in liquid form is cooled by spraying a gas or liquid on the metal.

16. The method of claim 15 in which the metal in liquid form is cooled by spraying nitrogen or argon on the metal.

17. The method of claim 11 including the step of:

cooling the metal in solid form after removing the metal from the region defined by the alternating magnetic field.

18. The method of claim 17 in which the metal in solid form is cooled by spraying air or liquid on it.

19. The method of claim 18 in which the metal in solid form is cooled by spraying water on the metal.

20. The method of claim 11 including the step of:

shielding said magnet from heat from the metal in the region defined by alternating magnetic field.

21. The method of claim 11 including the step of:

maintaining a leader sheet in the region defined by the alternating magnetic field;

removing the leader sheet from the region defined by the alternating magnetic field as metal in liquid form is being introduced to the region defined by the alternating magnetic field so that the metal in liquid form is confined by the alternating magnetic field and the leader sheet;

whereby a continuous casting process can be begun.

22. The method of claim 21 in which said leader sheet is slotted to engage the metal being cast.

23. The method of claim 21 in which said leader sheet is made of stainless steel.

* * * * *